US010077138B2

(12) United States Patent
Albrecht

(10) Patent No.: US 10,077,138 B2
(45) Date of Patent: Sep. 18, 2018

(54) HANDLED CONTAINER

(71) Applicant: San Jamar, Inc., Elkhorn, WI (US)

(72) Inventor: Brian Albrecht, Elkhorn, WI (US)

(73) Assignee: San Jamar, Inc., Elkhorn, WI (US)

( * ) Notice: Subject to any disclaimer, the term of this patent is extended or adjusted under 35 U.S.C. 154(b) by 49 days.

(21) Appl. No.: 15/045,527

(22) Filed: Feb. 17, 2016

(65) Prior Publication Data

US 2016/0236817 A1 Aug. 18, 2016

Related U.S. Application Data

(60) Provisional application No. 62/117,784, filed on Feb. 18, 2015.

(51) Int. Cl.

| | |
|---|---|
| ***B65D 25/10*** | (2006.01) |
| ***B65D 25/28*** | (2006.01) |
| ***B65D 25/32*** | (2006.01) |
| ***B65D 21/02*** | (2006.01) |
| ***B65D 25/22*** | (2006.01) |

(52) U.S. Cl.

CPC ..... *B65D 25/2897* (2013.01); *B65D 21/0212* (2013.01); *B65D 25/22* (2013.01); *B65D 25/2888* (2013.01); *B65D 25/32* (2013.01)

(58) Field of Classification Search

CPC .. B65D 23/003; B65D 25/2838; B65D 25/22; B65D 25/32

USPC ..... 220/751

See application file for complete search history.

(56) References Cited

U.S. PATENT DOCUMENTS

| | | | |
|---|---|---|---|
| 584,718 | A | 6/1897 | Witcher |
| 815,425 | A | 3/1906 | Hamilton |
| 930,824 | A | 8/1909 | Wood |
| 1,304,415 | A | 5/1919 | Tucker |
| 1,331,409 | A | 2/1920 | Barnett |
| 1,590,572 | A | 6/1926 | Fredette |
| 1,624,477 | A | 4/1927 | Davis, Jr. |
| 1,734,976 | A | 11/1929 | McClellan |
| 1,793,072 | A | 2/1931 | Fanan |
| 1,950,505 | A | 3/1934 | Matters |
| 2,038,826 | A | 4/1936 | Carroll |
| 2,143,027 | A | 1/1939 | Perry |
| 2,156,274 | A | 5/1939 | Brown |
| 2,228,536 | A | 1/1941 | Scalph |

(Continued)

FOREIGN PATENT DOCUMENTS

| | | |
|---|---|---|
| GB | 195523 | 7/1922 |
| JP | 10287339 | 10/1998 |

OTHER PUBLICATIONS

Canadian Patent Office Action dated Aug. 18, 2011; Canadan Patent Application No. 2,539,988—(2) pages.

(Continued)

*Primary Examiner* — Shawn M Braden

(74) *Attorney, Agent, or Firm* — Boyle Fredrickson S.C.

(57) ABSTRACT

A container assembly for carrying and pouring flowable materials and that includes a bucket that is defined by a closed bottom portion, an upstanding side portion, and an upper rim area that at least partially defines an open top. A handle is attached near the upper rim area and a plurality of gripping surfaces are located in the closed bottom portion of the bucket and/or defined by the side portion to permit multiple means of gripping the container. The container includes one or more posts or feet that facilitate a stacked and only partially nested association between containers oriented in a vertically stacked configuration.

23 Claims, 7 Drawing Sheets

(56) References Cited

U.S. PATENT DOCUMENTS 2,316,103 A 4/1943 Reed
2,508,258 A 5/1950 Heinrich
2,626,737 A 1/1953 Pitz
2,709,540 A 5/1955 Kenney
2,765,969 A 10/1956 Bennington
2,823,004 A 2/1958 Melloh
2,908,468 A 10/1959 Thomas
2,968,462 A 1/1961 Jones
3,014,621 A 12/1961 Povitz
3,111,153 A 11/1963 Sonka et al.
3,116,947 A 1/1964 Brownrigg
3,138,280 A 6/1964 Shafer
3,139,646 A 7/1964 Vernon
3,219,233 A 11/1965 Whiteford
3,229,820 A 1/1966 Hentzi et al.
3,329,321 A 7/1967 Moore
3,358,877 A * 12/1967 Eckhoff ..... A47J 47/18 220/775
3,425,012 A 1/1969 Gottinger
3,536,285 A 10/1970 Vahghn
3,578,205 A 5/1971 Ballester
3,590,416 A 7/1971 Henningsen
3,595,431 A 7/1971 Bird et al.
3,602,939 A 9/1971 Schoenholz
3,682,352 A 8/1972 Doucette
3,729,158 A 4/1973 Nagy
3,828,389 A 8/1974 Heisler
3,829,926 A 8/1974 Salladay
3,940,824 A 3/1976 Gioia et al.
4,013,187 A 3/1977 Betka
4,061,242 A 12/1977 Donlon
4,101,046 A 7/1978 Puntillo
4,149,663 A 4/1979 Agar
D252,439 S 7/1979 Smith
4,164,299 A 8/1979 Fuhr
4,177,896 A 12/1979 Weavers et al.
4,183,444 A 1/1980 English et al.
4,215,789 A * 8/1980 Pfeifer ..... B65D 25/32 220/762
4,337,565 A 7/1982 Diana
4,351,445 A 9/1982 Giggard et al.
4,355,597 A 10/1982 Blasbalg
4,418,883 A 12/1983 Cohen
4,446,969 A 5/1984 Tyler
4,478,346 A 10/1984 Spong
4,519,520 A 5/1985 Hill
4,519,565 A 5/1985 Whitmore
4,593,833 A 6/1986 Hill
4,627,546 A 12/1986 Carranza
4,825,590 A 5/1989 Cullinane
4,844,400 A 7/1989 Jasmagy, Jr.
4,860,891 A 8/1989 Biggio
4,869,385 A 9/1989 Blinsinger
4,895,269 A 1/1990 Cade
4,927,046 A 5/1990 Armstrong
4,928,873 A 5/1990 Johnson
4,941,586 A 7/1990 Tarna
4,966,300 A 10/1990 Coonradt
5,011,536 A 4/1991 Boom
5,033,704 A 7/1991 Kerr
5,083,733 A 1/1992 Marino et al.
5,085,391 A 2/1992 Berger et al.
5,092,481 A 3/1992 Skelton
5,147,067 A 9/1992 Effertz
5,169,025 A 12/1992 Guo
5,193,706 A 3/1993 Hanna et al.
5,222,656 A 6/1993 Carlson
5,236,340 A 8/1993 Hall et al.
5,276,943 A 1/1994 Ludy
5,277,733 A 1/1994 Effertz
5,279,452 A 1/1994 Huynh
5,308,181 A 5/1994 Hull et al.
5,320,249 A 6/1994 Strech
5,390,443 A 2/1995 Emalfarb et al.
5,400,916 A 3/1995 Weber
5,402,910 A 4/1995 Pilney
5,429,262 A 7/1995 Sharkey
5,511,279 A 4/1996 Ippolito
5,549,216 A 8/1996 Scholl
5,570,807 A 11/1996 Busch
5,624,093 A 4/1997 Gemmell
5,636,886 A 6/1997 Jensen
5,641,087 A 6/1997 Moffitt
5,716,034 A 2/1998 Unkefer
5,746,346 A 5/1998 Crilly
5,810,196 A 9/1998 Lundy
RE35,933 E 10/1998 Scholl
D401,116 S 11/1998 Demore
5,836,469 A 11/1998 Zebrowski
5,971,201 A 10/1999 Daw
6,027,152 A 2/2000 Sawdey
6,065,633 A 5/2000 Abbey
6,076,700 A 6/2000 Manges
6,119,303 A 9/2000 Passafiume
6,135,310 A 10/2000 Svehaug
6,135,467 A * 10/2000 Tagariello ..... B62B 3/104 280/79.11
6,138,963 A 10/2000 Malvasio
D435,728 S 1/2001 Miles et al.
D444,929 S 7/2001 Cox
6,260,730 B1 7/2001 Fellman
6,299,116 B1 10/2001 Levesque
6,352,169 B2 3/2002 Foster
D458,723 S 6/2002 Malvasio
D460,845 S 7/2002 Bergman
6,419,106 B1 7/2002 Bebak
D461,420 S 8/2002 Kerman
6,427,879 B1 8/2002 Caldwell
6,446,829 B1 9/2002 Malvasio et al.
6,474,607 B1 11/2002 Wilson
D466,407 S 12/2002 Nance
D486,700 S 2/2004 Wright
6,708,838 B2 3/2004 Bergman
D493,035 S 7/2004 Bergman
6,953,523 B2 10/2005 Vandenbelt et al.
6,991,829 B2 1/2006 Bergman
7,024,816 B1 4/2006 Marks et al.
7,399,017 B1 7/2008 Lasseigne
D581,118 S 11/2008 Bergman
7,467,728 B2 * 12/2008 Lundy ..... B44D 3/12 220/505
D604,471 S 11/2009 Bergman
7,665,359 B2 2/2010 Barber
D627,119 S 11/2010 Bergman
7,959,030 B2 6/2011 Bergman
8,550,285 B2 10/2013 Bergman et al.
8,556,116 B2 10/2013 Bergman et al.
D697,281 S 1/2014 Bergman et al.
D761,511 S * 7/2016 Malvasio ..... D32/53.1
9,417,002 B2 * 8/2016 Carlson ..... B65D 25/32
9,555,930 B2 * 1/2017 Campbell ..... B65D 25/2844
9,657,981 B2 5/2017 Carlson et al.
2002/0036206 A1 3/2002 Bergman et al.
2002/0056714 A1 5/2002 Schinkel
2003/0052243 A1 3/2003 Kolton et al.
2005/0006268 A1 1/2005 Futernick
2006/0243732 A1 11/2006 Bergman
2007/0210229 A1 9/2007 Brenner et al.
2008/0035655 A1 2/2008 Baumgartner
2008/0099649 A1 5/2008 Cavasos
2009/0032542 A1 2/2009 Temple
2009/0294318 A1 12/2009 Monahan
2010/0187242 A1 7/2010 Lynch et al.
2013/0284306 A1 10/2013 Carlson et al.
2015/0360818 A1 * 12/2015 Condiff ..... B65D 25/2897 220/608

OTHER PUBLICATIONS

PCT/US05/16762 Written Opinion of the international Search Report dated Oct. 24, 2005—(3) pages.

(56) References Cited

OTHER PUBLICATIONS

PCT/US05/16762 Notification of Transmittal of the International Search Report and the Written Opinion of the International Searching Authority, or the Declaration—(1) page.
PCT/US2005/016762 International Preliminary Report on Patentability dated Nov. 14, 2006—(1) page.
PCT/US05/16762 International Search Report dated Oct. 24, 2005—(3) pages.
Office Action dated Nov. 1, 2007, U.S. Appl. No. 11/378,071.
Office Action dated Jul. 3, 2008, U.S. Appl. No. 11/378,071.
Office Action dated Jan. 21, 2009.

* cited by examiner

HANDLED CONTAINER

CROSS REFERENCE TO RELATED APPLICATIONS

This application claims priority to U.S. Provisional Patent Application Ser. No. 62/117,784 filed on Feb. 18, 2015 titled "HANDLED CONTAINER" and the disclosure of which is incorporated herein.

BACKGROUND OF THE INVENTION

This invention relates generally to an apparatus for use in connection with manually portable containers or similar products. More particularly, the invention relates to containers that have closed bottoms and handles to facilitate manual or hand transport of the container whether loaded or unloaded.

Containers have proven very useful for transporting items and then pouring or dumping items from the container. For example, containers are used commonly in the restaurant business to transport flowable materials, such as ice for instance. A container is first filled with ice and then moved to the desired location and tilted, thereby dumping the ice. Commonly, the handle is defined by a piece of metal wire attached at two points on the container. These two points are usually positioned equidistant from one another around a perimeter edge associated with an opening in the container.

Containers have also been modified to increase the ease with which material may be poured or dumped from the container. For example, a supplemental handle or gripping surface or site may be positioned on the container. Such handles or gripping surfaces allow a user to more firmly grab the container during the pouring or dumping process. The handle or gripping surface may be positioned on the side of the container or around the periphery of the bottom of the container. U.S. Pat. No. 1,173,305 to Phelan discloses a handle or gripping surface positioned on the side of the container. United States Patent Publication Number 2003/0116577 to Slongo et, al. discloses handles near the top of the container and two gripping surfaces located across from one another around the outer side of the bottom of a container.

A handle or gripping surface positioned on the side or the periphery of the bottom of the container may provide a leverage point for easier pouring or dumping of material from the container. However, such handles or gripping surfaces only provide a user with a single leverage point. In order to lift, carry, pour, and/or dump heavy or awkward materials, a user may desire to have several different leverage points at which to securely grasp or grab a container. For example, a user may desire to grab different leverage points based on the user's strength and/or height, the amount of material in the container, the height of the area into which the material in the container is to be poured or dumped, and/or other performance characteristics.

Still further, when such containers are used to transport ice or other product where contamination is an issue, many designs do not permit such containers to be picked up from the ground without the user's hand touching the ground when engagement with a second gripping location aside from the handle is required. As a result, once a transported material is poured out of the container and the user engages the material for smoothing, dispensing or other rearrangement, if the user's hand comes in contact with the material, any unsanitary material picked up from the floor or other support surface when the container was picked up subsequently contaminates the dispensed material.

Still further considerations relate to maintaining sanitary conditions of the container when not in use as a transport vessel. When used for ice or other foodstuffs, it is commonly desired to maintain a dedicated container for such functions to mitigate contamination of the consumable materials by transport with a less than sanitary vessel or a vessel recently used to transport a different material. Providing a dedicated container requires protecting the integrity of the sanitation of the vessel when the vessel is not in use or is otherwise stored. Such considerations include concerns related to the stacking of multiple vessels in a slidable bypassing or nesting arrangement wherein contaminants on the exterior surface of one vessel may be transferred to the interior facing surfaces of an adjacent vessel. Still further considerations relate to supporting the vessel in a self-draining orientation when not in use to prevent the collection of moisture or other matter in the cavity defined by such vessels when left in an upturned orientation.

Accordingly, many existing containers suffer from certain drawbacks and limitations. Accordingly, a need exists for a container that is easy to use, relatively inexpensive to manufacture, and solves other problems associated with the existing designs

SUMMARY OF THE INVENTION

The present invention discloses a manually transportable container that solves one or more of the shortcomings disclosed above. One aspect of the invention discloses a container assembly for carrying and pouring flowable materials. The container assembly includes a bucket that is defined by a closed bottom portion, an upstanding side portion, and an upper rim area that at least partially defines an open top. A handle is attached near the upper rim area of the bucket and a plurality of gripping surfaces are located in the closed bottom portion of the bucket and/or defined by the side portion and permit multiple means of gripping the container assembly. The container and/or bucket include one or more posts or feet that facilitate a stacked and only partially nested association between adjacent containers when they are oriented in a vertically stacked configuration.

Another aspect of the invention that includes various features and aspects that are useable or combinable with one of the more of the features or aspects disclosed above discloses a container for carrying and pouring flowable materials that includes a bucket portion having a side portion, a closed bottom portion and an upper rim area at least partially defining an open top. A handle is attached to the bucket portion proximate the upper rim area. At least one gripping location is defined by the bucket portion and is formed proximate the closed bottom portion. At least one hanger is defined by the bucket portion and formed proximate the upper rim area and defined by a gap formed between the side portion and the at least one hanger. The gap is defined by an open end that faces in a direction toward the closed bottom portion such that the container can be suspended in a generally vertical orientation.

A further aspect of the invention that is usable or combinable with one or more of the above features or aspects discloses an ice tote having a body that is defined by a closed end and an upstanding side wall that terminates at an opening defined by the body. A handle is pivotably connected to the body proximate the opening. A plurality of grip sites are defined by the body and at least one grip site is defined by the closed end of the body. At least one projection is disposed between the handle and a bottom surface defined by the closed end of the body. The projection extends in an outward radial direction from the body and is constructed to facilitate non-nested stacking of vertically adjacent ice totes.

Another aspect of the invention that is usable or combinable with the one or more of the above features or aspects discloses a method of forming an ice tote. The method includes forming a container body to define a blind hole wherein a portion of a perimeter of an opening associated with the blind hole defines a spout of the container. A bottom of the blind hole is formed to define a hand grip that is oriented on a lateral side of the container body that is opposite the spout. A first boss and a second boss are formed by a portion of the container body such that the first boss and the second boss are aligned with one another and are each oriented in a radial direction between the spout and the hand grip. A handle index is defined in each of the first boss and the second boss and a handle is provided that includes a pair of pivot assemblies. Each pivot assembly is constructed to cooperate with a respective one of the first boss and the second boss and is movable in an axial direction along an axis of rotation of the handle in only two radial positions relative to the container body. Each of the two radial positions is offset from a vertical axis and a horizontal axis that each pass through the axis of rotation.

Another aspect of the invention discloses a container that is defined by a body that forms a blind hole. A bottom of the body has one or more gripping surfaces. A hook is defined by the body near the open end of the container and extends in a downward direction in an offset manner from a sidewall associated with the primary volume of the container. The hook can function to support the container from a terminal end of an upright wall structure and as a handle during dumping operations. A pair of posts or feet extend from generally opposite lateral sides of the container near the bottom of the blind hole and are situated such that the container can be supported by another similarly constructed container in a stacked but not tightly nested configuration. In a preferred embodiment, the container includes a hook that is oriented on a side of the container between the sides associated with the posts. The hook is constructed to cooperate with a hanger secured to a wall or with a discrete member of an expended metal shelving assembly such that the container can be hung such the open end of the container is oriented in a downward facing direction.

These and other aspects, features, and advantages of the present invention will become apparent from the detailed description, claims, and accompanying drawings.

DESCRIPTION OF THE DRAWINGS

The drawings illustrate one preferred embodiment presently contemplated for carrying out the invention and in the drawings.

DETAILED DESCRIPTION OF THE PREFERRED EMBODIMENTS

Figure 1:
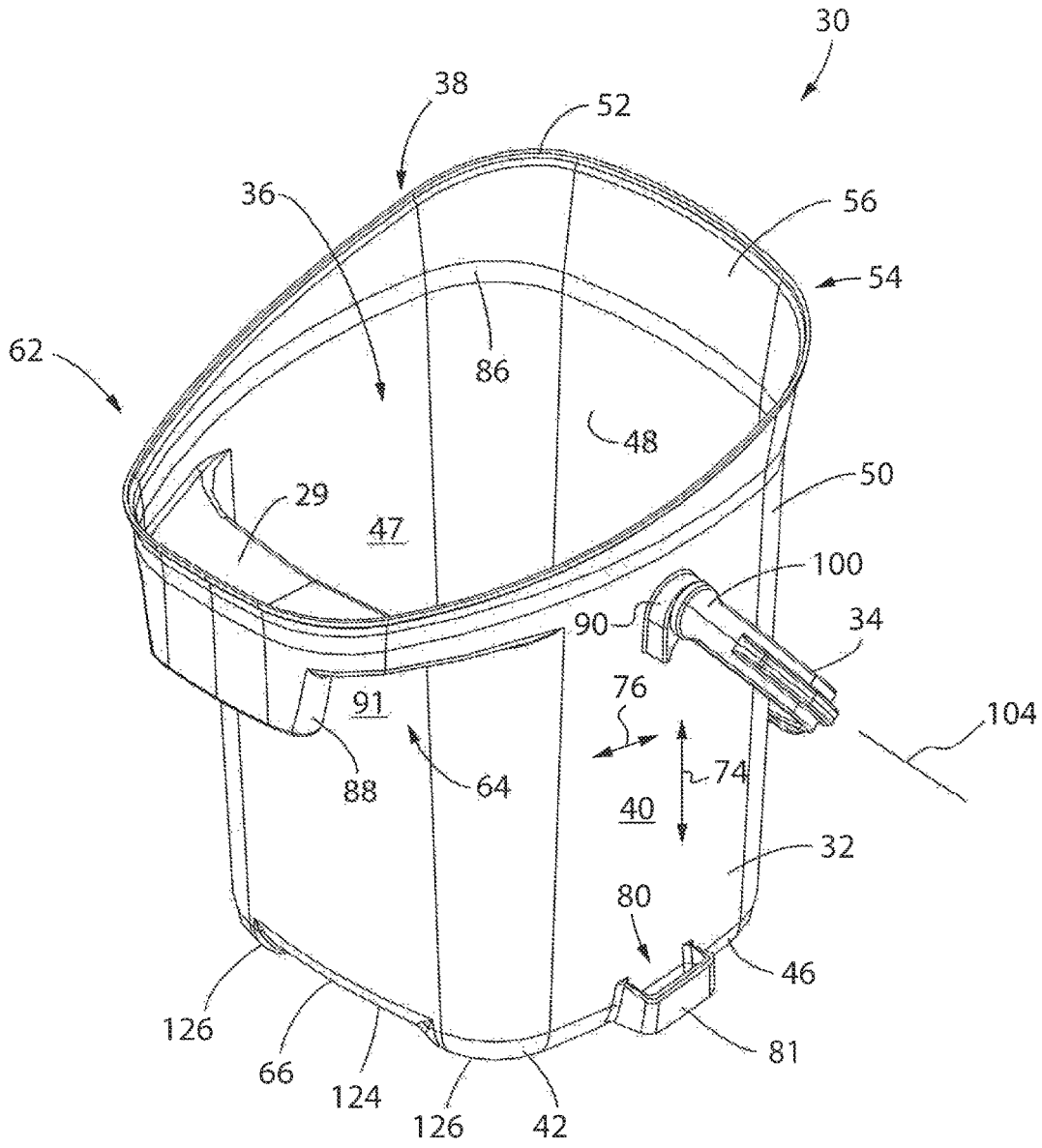
FIG. 1 is an upper perspective view of a container assembly, handled container, or simply container according to the present invention.

FIGS. 1-5 show various views of a container assembly, a handled container, or simply a container 30 according to the present invention. Container 30 is defined by a body or bucket portion 32 having a handle 34 that is attached thereto. As disclosed further below, handle 34 is secured to bucket portion 32 such that handle 34 is pivotable or rotational relative to bucket portion 32. A majority of bucket portion 32 is defined by a first blind opening 36 that extends in a longitudinal direction between an open end or mouth 38 and a base portion or bottom 42 of bucket portion 32. Bucket portion 32 includes a sidewall portion 40 that extends in a generally circumferential and longitudinal direction between mouth 38 and bottom 42. It is appreciated that sidewall portion 40, although shown as having a somewhat rectilinear shape, could have virtually any, fixed or changing, cross-sectional shape, as it extends between mouth 38 and bottom 42 of bucket portion 32.

Bottom 42 includes an interior facing surface 44 and an exterior facing surface 46 relative to a volume 47 defined by bucket portion 32. Sidewall portion 40 also includes an interior facing surface 48 and an exterior facing surface 50 relative to the volume 47 defined by bucket portion 32 of container 30. An upper perimeter edge 52 associated with sidewall portion 40 defines the shape of mouth 38 and preferably includes a top portion 54 that defines a spout 56 associate with use of bucket portion 32. It should be appreciated that volume 47 can be defined as a blind hole that is circumferentially bounded by sidewall portion 40 and terminates at bottom 42. As disclosed further below with respect to FIGS. 5 and 7, handle 34 pivotably cooperates with bucket portion 32 such that handle 34 can swing across the footprint associated with mouth 38 during filling and dumping operations in a manner that avoids obstruction of the mouth 38 and/or the spout 56 by the handle 34 and/or a user's hand associated therewith.

Figure 2:
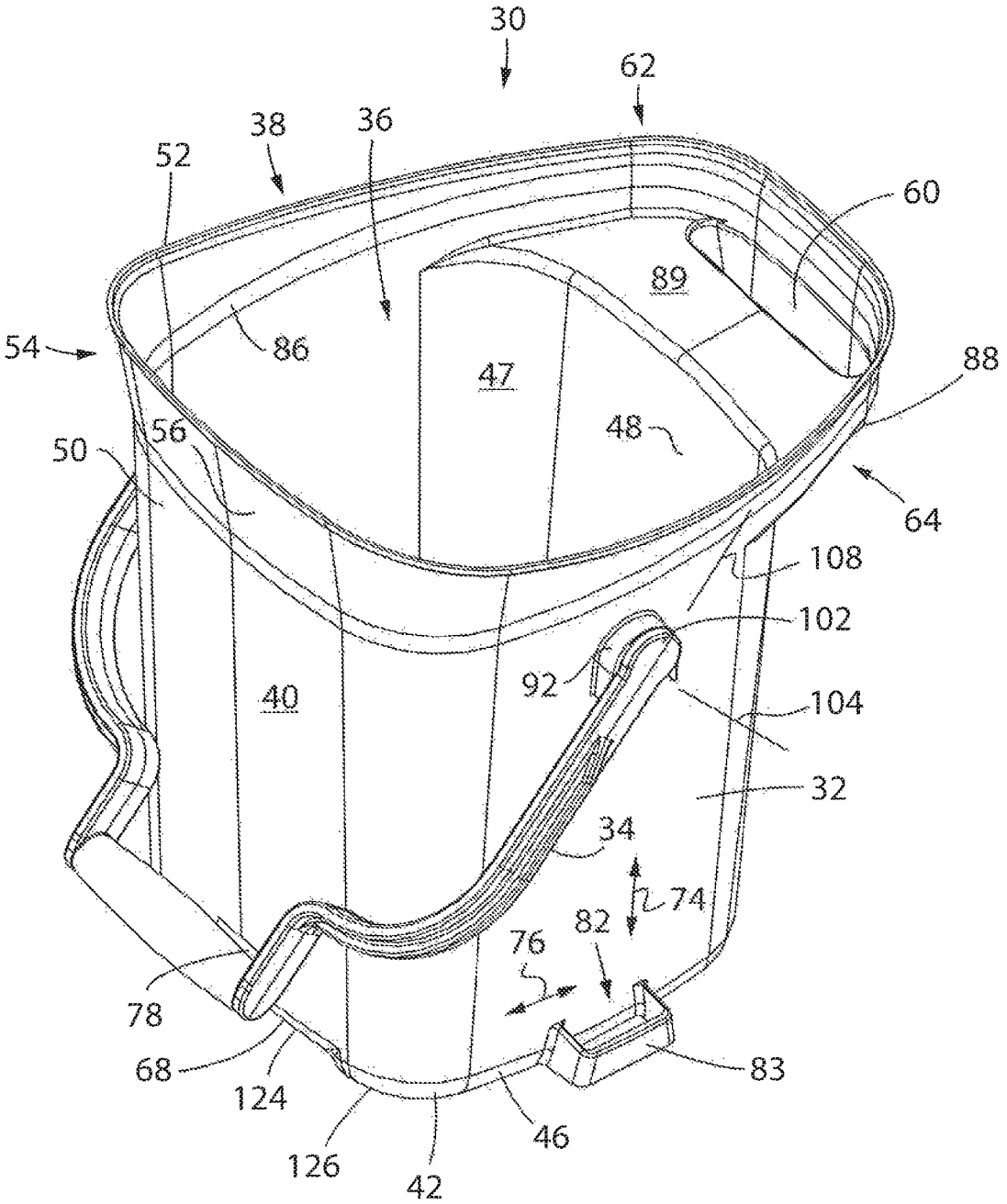
FIG. 2 is an upper alternate perspective view of the container shown in FIG. 1.

Still referring to FIGS. 1 and 2, bucket portion 32, and more specifically sidewall portion 40 and/or top portion 54, is shaped to define a second blind hole 60 that extends in a downward direction relative to upper perimeter edge 52. As disclosed further below with respect to FIGS. 4 and 5, sidewall portion 40 includes a radially extending portion 62 disposed proximate mouth 38 which offsets second blind hole 60 from the blind hole associated with volume 47 such that a downward facing channel 64 (when container 30 is oriented in an upward facing orientation) is defined by sidewall portion 40 of bucket portion 32. As disclosed further below, channel 64 is constructed to accommodate an upright hanging orientation of container 30 when a support structure, such as an edge of an ice bin or the like, is disposed in channel 64.

Figure 3:
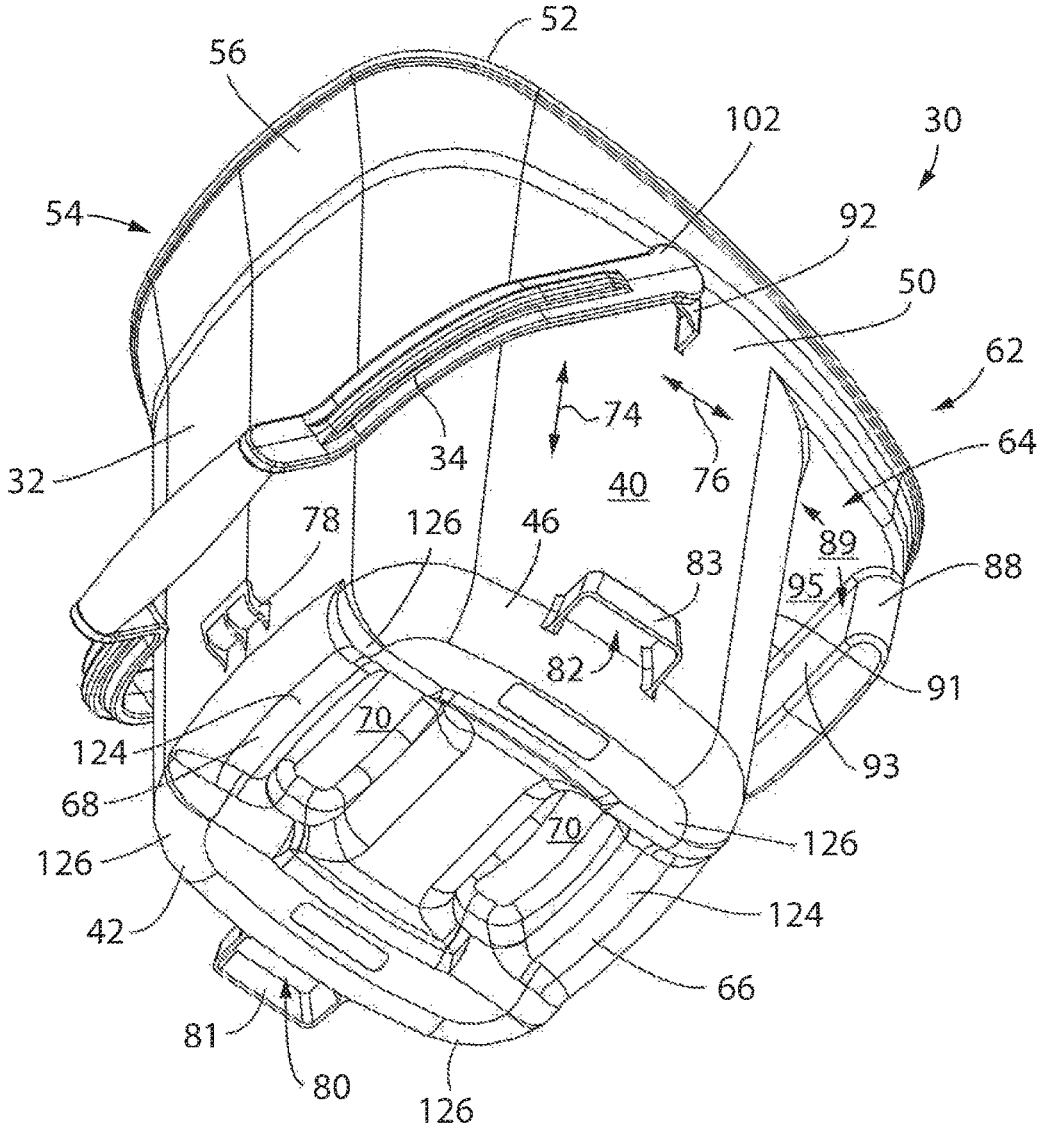
FIG. 3 is a lower perspective view of the container shown in FIG. 1.
Figure 4:
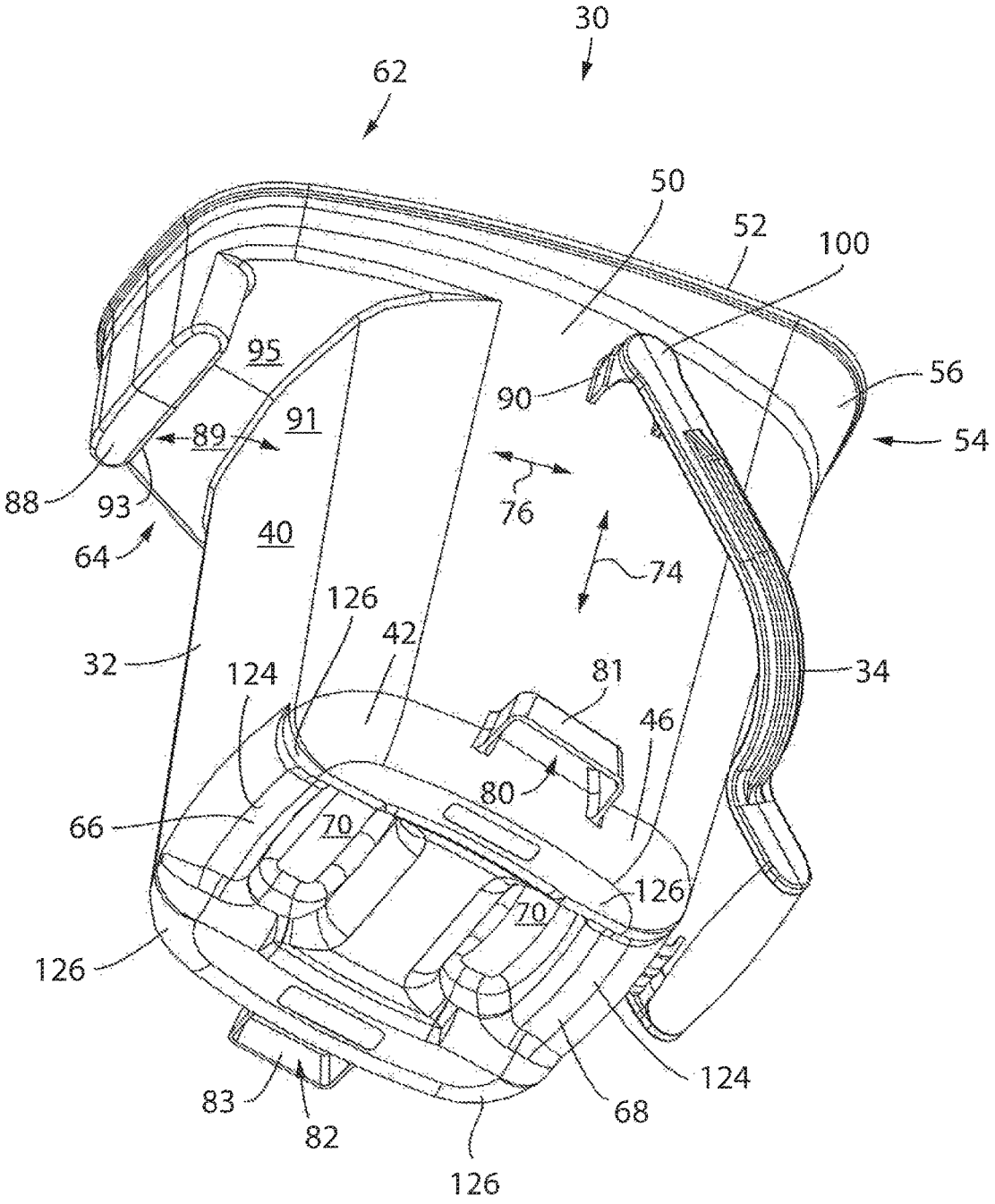
FIG. 4 is an alternate lower perspective view of the container shown in FIG. 1.

Referring to FIGS. 1-4, the bottom 42 of container 30 defines at least two distinct grip sites, gripping sites, grip surfaces, or gripping surfaces 66, 68. Preferably, gripping surfaces 66, 68 are separated by at least one indentation 70 relative to a radially interior oriented surface associated with bottom 42 of container 30. Referring to FIGS. 3 and 4, the indentation 70 generally divides the bottom 42 into two distinct gripping surfaces 66, 68 that are generally aligned with a perimeter edge of container 30 proximate bottom 42. Preferably, gripping surfaces 66, 68 are offset from the axis of rotation associated with handle 34 both in a longitudinal direction, indicated by arrow 74, and a lateral direction, indicated by arrow 76. Gripping surfaces 66 and 68 are provided generally along the outer edge of the bottom 42 of the container 30 and configured to receive a respective user hand as it wraps about the bottom perimeter edge of container 30 during a pouring or carrying operation.

Indentation 70 and gripping surfaces 66, 68 cooperate with one another so as to be generally approximately about 1.5 inches deep to provide a positive interaction and indexing with the user's hand when engaged therewith. The gripping surfaces 66, 68 and indentation(s) 70 may take any number of forms. For example, the gripping surfaces 66, 68 and indentation(s) may be ergonomically designed to fit with a user's hand for a more secure grip. In another example, the indentation(s) may be formed so as to provide a ridge or other structure on a gripping surface 66, 68 or in the indentation(s) 70 themselves so that a user may have a better hold on the bottom 42 of the container 30. The gripping surfaces 66, 68 and/or indentation(s) may also have ribs, bumps, or other features so that a user's hold on the bottom 42 may be more secure. Regardless of the form of the gripping surfaces 66, 68 and the indentation(s) 70, bottom 42 is preferably designed so that container 30 rests flat when placed on a horizontal surface while gripping surfaces 66, 68 are maintained in an offset or spaced relationship relative to the support surface. Said in another way, when container 30 is set upon a horizontal surface, such as a countertop, shelf, or a floor, gripping surfaces 66, 68 remain offset from supporting surface to mitigate transference of contaminants to gripping surfaces 66, 68 when container 30 is not in use. In addition, bottom 42 may be configured to meet safety and health standards, such as those set forth by the National Sanitation Foundation.

Figure 5:
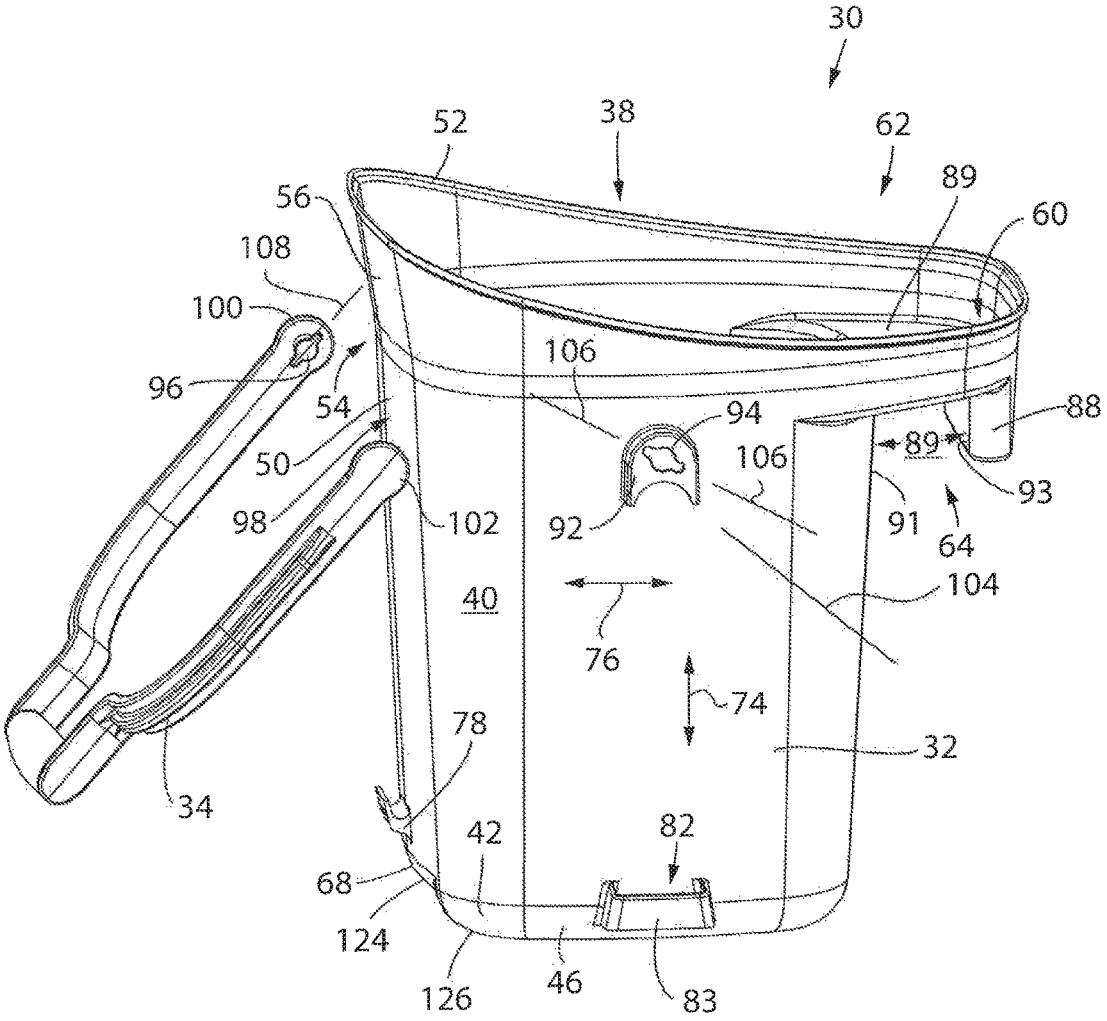
FIG. 5 is a side perspective view of the container shown in FIG. 1 with the handle exploded from the body of the container.
Figure 6:
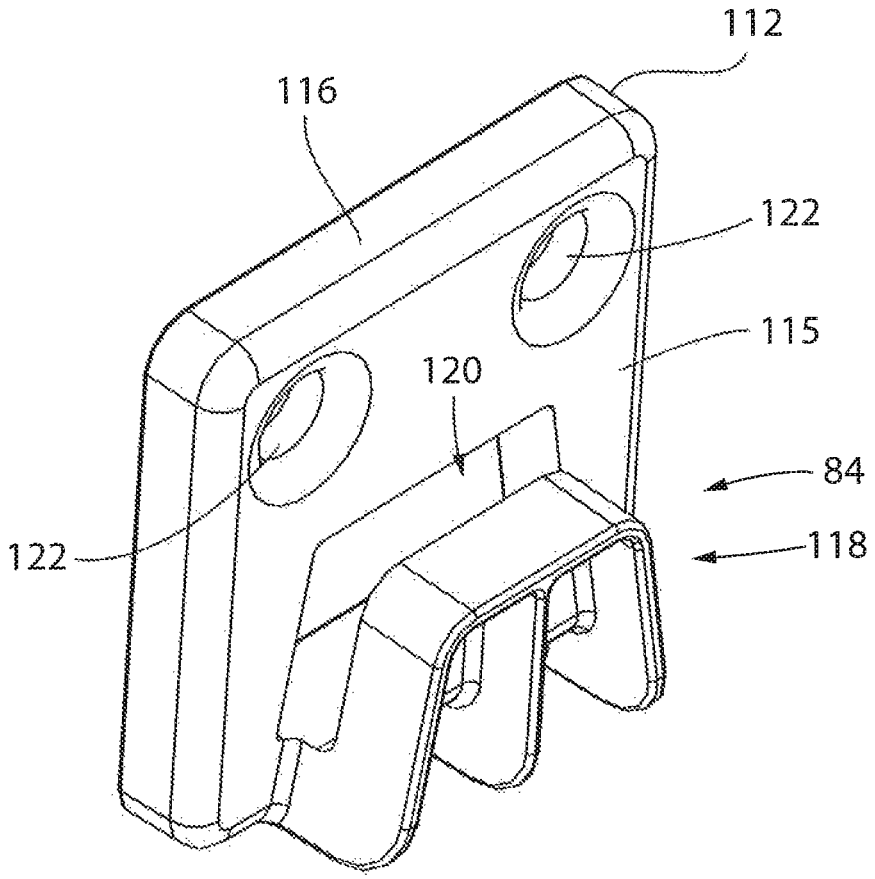
FIG. 6 is a perspective view of a hanger that removably cooperates with the container shown in FIG. 1.
Figure 7:
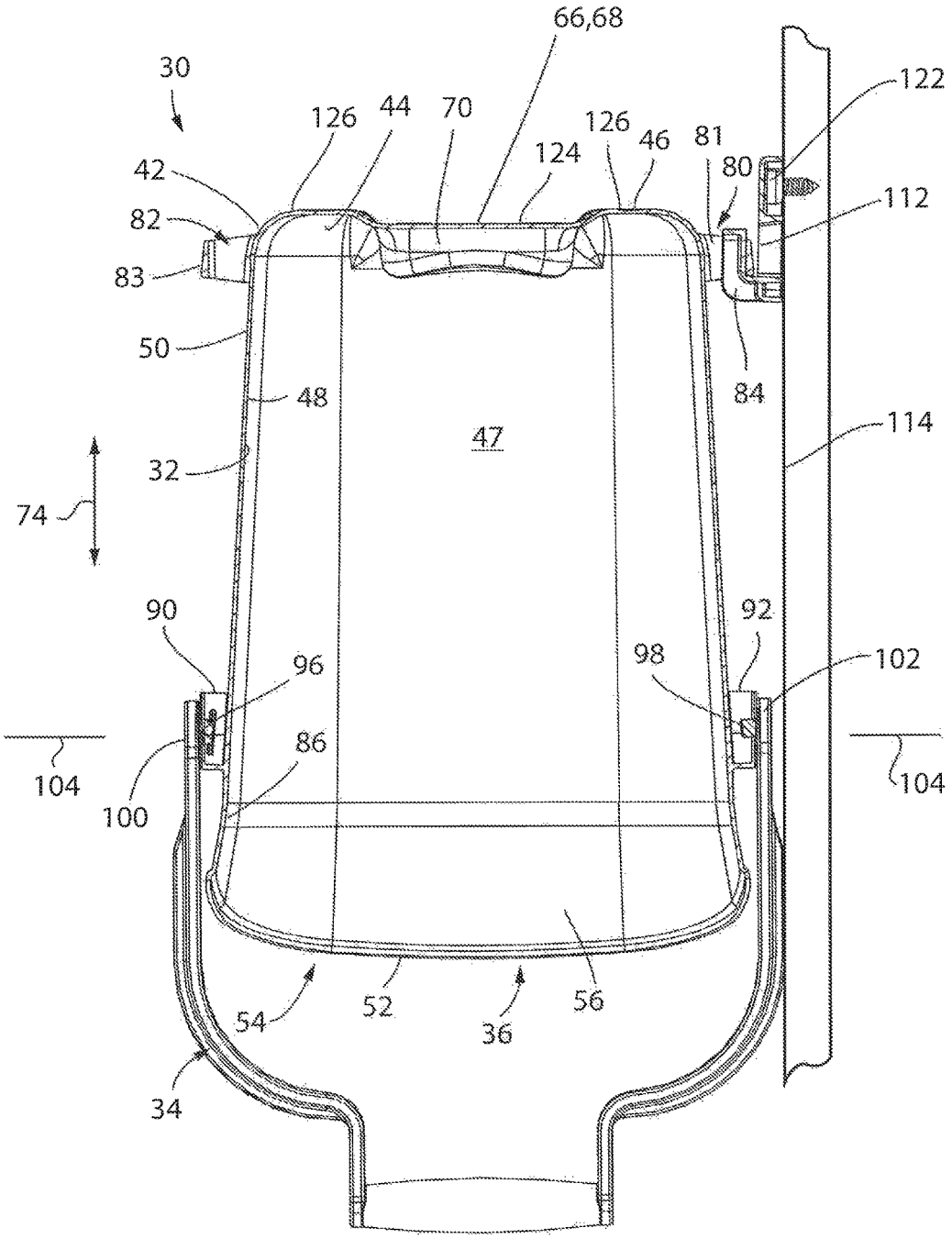
FIG. 7 is a partial section view of the container shown in FIG. 1 engaged with the hanger shown in FIG. 6 and suspended from a support structure in an inverted orientation.

The bottom 42 may be formed as part of the container 30 or may be a separate piece fit onto or attached to the container 30. Where the bottom is a separate piece, it is intended to be affixed to the container 30 such that it does not separate therefrom. In other words, the bottom 42 is not intended to function as a removable lid. The bottom 42 may be part of or added on to any type of container such as a bucket, ice tote, food container, cooler or the like. As shown in FIGS. 1-7, whether provided as an integral or removable feature, bottom 42 may have additional structures provided thereon to improve the functionality of the container. For example, as shown in FIGS. 3 and 5, the bottom 42 may have a hook 78 and one or more feet, posts, or projections 81, 83 that each extend from container 20 and define a respective hanging recesses 80, 82. Hook 78 and recesses 80, 82 may be used to selectively attach or support container 30 in an inverted orientation relative to a support, such as a supplemental hook 84 as shown in FIGS. 6 and 7, or other support structures, such as a wire form rack or other structure for storage as disclosed further below.

Although recesses 80, 82 are constructed to cooperate with the likes of a supplemental hook 84 as disclosed further below, feet, posts, or projections 81, 83 associated with respective recesses 80, 82 are constructed to cooperate with a mouth of a vertically adjacent container 30 such that a plurality of containers 30 can be stacked but do not tightly nest with one another. Preferably, the feet, posts, or projections 81, 83 which define respective recesses 80, 82 cooperate with a lip 86 (FIG. 1) that is formed proximate the mouth of container 30 and allow ventilation between a stacked but generally un-nested, or only loosely nested, plurality of containers 30. In addition to accommodating ventilation and/or evaporation associated with the use of container 30, such a construction also mitigates the potential for contamination between an exterior surface of one container with an interior surface of another container when a plurality of containers are oriented in a stacked and only loosely nested storage orientation.

As alluded to above, container 30 also defines another handle/hanging structure 88 associated with channel 64 formed proximate the mouth 38 defined by container 30. Hanging structure 88 has a general hook shape and defines a gap 89 that is formed between a side surface portion 91 of container 30, an interior facing surface portion 93 of structure 88, and a surface 95 that extends in a generally radial or lateral direction relative to a longitudinal axis of container 30 between side surface portion 91 and surface portion 93 such that channel 64 has a generally n-shape cross section shape. Gap 89 is preferably sized to support container 30 when hung upon the edge of a vertical upstanding wall, such as the side wall of an ice bin or the like, and also shaped and defined by container 30 to provide yet another grip site that is nearer mouth 38 for pouring contents from container 30.

Referring to FIG. 5, container 30 includes a first boss 90 and a second boss 92 that are oriented on generally opposite lateral sides of container 30 proximate mouth 38. First boss 90 and second boss 92 are constructed to secure handle 34 relative to container 30 such that handle 34 remains pivotable relative to container 30. Each boss 90, 92 includes an opening 94 that is shaped to slidably cooperate with a projection 96, 98 associated with a respective opposite longitudinal end 100, 102 of handle 34. Projections 96, 98 and openings 94 are shaped to slidably cooperate with one another relative to an axis of rotation of handle 34, indicated by line 104 (FIG. 7) but to do so only at discrete or selected radial orientations of handle 34 relative to container 30.

FIG. 5 includes an indication of an axis line 106 along which the longitudinal axis of handle 34, indicated by line 108, must be oriented to accommodate the axial translation of projections 96, 98 relative to their respective boss 90, 92. Said in another way, handle 34 is constructed to removably cooperate with bosses 90, 92 only when handle 34 is oriented at a limited number of preferably non-orthogonal positions relative to container 30. When handle 34 is positioned in the plane associated with axis 108, the opposite longitudinal ends 100, 102 of handle 34, and the respective projections 96, 98 associated therewith, are translatable in a respective outward radial direction along axis 104 associated with the axis of rotation of handle 34 to allow the selective engagement of the respective projection 96, 98 with a respective boss 90, 92 associated with container 30. When not positioned along axis 108, projections 96, 98 cooperate with the respective bosses 90, 92 defined by bucket portion 32 of container 30 such that handle 34 is rotationally or pivotably connected to bucket portion 32 of container 30 but securely attached thereto. Such a rotation association mitigates incidence of undesired and/or unintentional separation between handle 34 and bucket portion 32 of container 30 during use and/or storage of the container 30.

As alluded to above and referring to FIGS. 6 and 7, container 30 preferably includes at least one optional hanger 112 that is constructed to be secured to a vertical support surface 114 (FIG. 7) and which removably cooperates with respective recesses 80, 82 defined by the body of container 30. Hanger 112 is defined by a body 115 and includes a base portion 116 and a hook portion 118 that is offset from base portion 116 to define a channel 120 therebetween. Base portion 116 includes one or more openings 122 that are constructed to cooperate with a fastener to secure hanger 112 relative to support surface 114 such that, when secured to vertical support surface 114, an open end of channel 120 faces in a generally upward oriented direction.

Referring to FIG. 7, when hanger 112 is secured to support surface 114, hook portion 118 of hanger 112 is oriented to slidably cooperate with a respective recess 80, 82 associated with a respective foot, post, or projection 81, 83 defined by container 30 such that container 30 can be oriented in an inverted vertical orientation when not in use. Vertical translation of container 30 relative to hanger 112 allows the selective removal of the respective foot, post, or projection 81, 83 from interfering engagement with hook portion 118 of hanger 112 during use of container 30. The inverted vertical orientation of container 30 when engaged with hanger 112 facilitates drainage of the volume defined by container 30 and maintains container 30 in a sanitary configuration wherein the mouth of container 30 is oriented in a generally downward facing direction. Such a consideration mitigates the undesired placement or collection of material in the volume defined by container 30 when container 30 is not in use thereby improving sanitation associated with the use of container 30.

Still referring to FIG. 7, it can be appreciated that a lowermost surface 124 associated with grip sites or gripping surface 66, 68 is offset nearer the open end or mouth 38 of container 30 than the adjacent radially outward oriented portions 126 of bottom 42 of container 30. Such a consideration ensures that users removing container 30 from hanger 112, even in those situations wherein container 30 was previously supported by a floor, countertop, or ground surface, are not required to contact the same surface as was previously in contact with a potentially less sanitary surface. The contour of grip sites or gripping surfaces 66, 68 mitigates corrupting the sanitation of grip sites or gripping surfaces 66, 68 as container 30 is transferred between use and storage locations.

As disclosed above, container 30 provides a plurality of distinct gripping, hanging, and supporting surfaces that each discretely allow a user to conveniently fill, empty, tilt, transport, and store container 30 in various positions. The ability for a user to grab a gripping surface and employ different grips and/or grip styles reduces the amount of effort required to pour or dump material from a container 30. Further, this structure provides a user with the means to achieve a more secure grip thereby minimizing accidental spillage of material from the container 30.

It is further appreciated that container 30 can have applications aside from use in connection with ice, liquid, or other materials. Further, the invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents, alternatives, and modifications, aside from those expressly stated, are possible and within the scope of the appending claims.

What is claimed is:

1. A container for carrying and pouring flowable materials, the container comprising:

a bucket portion having a side portion, a closed bottom portion and an upper rim area at least partially defining an open top;

a handle attached to the bucket portion proximate the upper rim area;

at least one gripping location defined by the bucket portion and formed proximate the closed bottom portion;

at least one hanging structure defined by the bucket portion and formed proximate the upper rim area and defined by a gap formed between the side portion and the at least one hanging structure;

at least one foot that extends in outward lateral direction from the bucket pardon, the at least one foot configured to accommodate stacking of adjacent containers; and a hook disposed proximate the closed bottom portion and oriented on a side of the bucket portion opposite the at least one foot and an another foot.

2. The container of claim 1 wherein the handle is pivotably connected to the bucket portion via the side portion such that each of opposite ends of the handle are oriented proximate a respective one of alternate ends of the gap.

3. The container of claim 2 wherein the opposite ends of the handle cooperate with a boss defined by the bucket portion and are removable therefrom at rotational orientations of the handle relative to the bucket portion that are offset from an orientation wherein the handle is directly above the open top or oriented normal to the handle being directly above the open top.

4. The container of claim 1 wherein adjacent containers are slidable relative to one another to slide past less than 25% of a longitudinal depth of either respective container.

5. The container of claim 1 wherein the at least one foot and the another foot extend in opposite lateral directions from the bucket portion.

6. The container of claim 5 wherein the at least one foot and the another foot are each aligned with a respective boss that is configured to pivotably secure a respective end of the handle relative to the bucket portion.

7. The container of claim 1 wherein the gap is defined by an open end that faces in a direction toward the closed bottom portion of the bucket portion and such that an imaginary plane that is coincident with a gap facing surface of the hanging structure intersects an imaginary plane that is coincident with a gap facing surface of the side portion of the bucket portion at a location above the upper rim of the bucket portion.

8. The container of claim 1 wherein the at least one gripping location is further defined as a first gripping location and a second gripping location that each extend in a direction aligned with and offset from an axis of rotation of the handle.

9. An ice tote comprising:

a body defined by a closed end and an upstanding side wall that terminates at an opening defined by the body;

a handle pivotably connected to the body proximate the opening;

a plurality of grip sites defined by the body wherein at least one grip site is defined by the closed end of the body;

at least one post disposed between the handle and a bottom surface defined by the closed end of the body, the at least one post having a fixed shape and orientation relative to the body and extending outward from the body in a direction that is generally aligned with an axis of rotation of the handle and constructed to facilitate non-nested stacking of vertically adjacent ice totes; and a hook extending from the body at a location between the at least one post and an another post that is a mirror construction of the at least one post.

10. The ice tote of claim 9 wherein the hook extends from the body at a location generally under a spout defined by a portion of the upstanding wall proximate the opening.

11. The ice tote of claim 9 further comprising a hanger constructed to removably cooperate with at least one of a hook and the at least one post and securable to a vertical surface, the at least one of the hook and the at least one post being oriented to cooperate with the hanger such that the body can be hung in a vertical position with the opening in a downward facing direction.

12. The ice tote of claim 9 further comprising another post defined by the body and oriented on a side of the body generally opposite the post, the post and another post being generally mirror images of one another.

13. The ice tote of claim 9 wherein the body further defines a hanging structure that is formed near the opening defined by the body and is oriented such that the hanging structure is offset in an outward radial direction from the upstanding side wall of the body and defines a channel having a generally n-shaped cross section shape wherein an opening of the channel faces in a direction toward the closed end of the body.

14. The ice tote of claim 13 wherein the hanging structure is formed by an upward facing blind hole defined by a portion of the body.

15. A method of forming an ice tote, the method comprising:

forming a container body to define a first blind hole and a second blind hole wherein a portion of a perimeter of an opening associated with the first blind hole defines a spout and the second blind hole has an open end that faces in the same direction as the opening of the first blind hole and such that the open end of the second blind hole is offset by a surface that extends in a radial lateral direction relative to a longitudinal axis of the container body from the first blind hole;

forming a channel having an n-shaped cross section shape in an outward facing surface of the container body between the first blind hole and the second blind hole wherein the channel is defined by a first blind hole surface that faces a second blind hole surface and an imaginary plane that contains with the first blind hole surface intersects another imaginary plane that contains with the second blind hole surface at a location above the perimeter of the opening of the container;

forming a bottom of the second blind hole to define a hand grip that is oriented on a lateral side of the container body that is opposite the spout;

forming a first boss and a second boss with a portion of the container body such that the first boss and the second boss are aligned with one another and are each oriented in a radial direction between the spout and the hand grip;

defining a handle index in each of the first boss and the second boss; and providing a handle having a pair of pivot assemblies wherein each pivot assembly is constructed to cooperate with a respective one of the first boss and the second boss and is movable in an axial direction along an axis of rotation of the handle in only two radial positions relative to the container body and each of the two radial positions is offset from a vertical axis and a horizontal axis that each pass through the axis of rotation.

16. The method of claim 15 further comprising forming the hand grip such that an exterior surface associated with the hand grip is offset toward the perimeter of the opening from a ground support defined by the container body.

17. The method of claim 15 further comprising forming at least one post that extends in an outward radial direction from the container body proximate the bottom of the blind hole and prevents nested stacking of the ice tote with a vertically adjacent ice tote.

18. The method of claim 17 further comprising forming the at least one post to cooperate with a hanger that removably cooperates with the at least one post to support the ice tote in a vertical orientation.

19. The method of claim 15 further comprising forming a hook that extends in an outward radial direction from the container body and is circumferentially disposed between a first post and a second post that extend in opposite radial directions from the container body.

20. A container for carrying and pouring flowable materials, the container comprising:

a bucket portion having a side portion, a closed bottom portion and an upper rim area at least partially defining an open top;

a handle attached to the bucket portion proximate the upper rim area;

at least one gripping location defined by the bucket portion and formed proximate the closed bottom portion;

at least one hanging structure defined by the bucket portion and formed proximate the upper rim area and defined by a gap formed between the side portion and the at least one hanging structure and wherein the gap is defined by an open end that faces in a direction toward the closed bottom portion;

a first foot that extends in an outward lateral direction from the bucket portion and a second foot that extends in an opposite outward lateral direction relative to the first foot, the first foot and the second foot being configured to accommodate stacking of adjacent containers, wherein adjacent containers are slidable relative to one another to slide past less than 25% of a longitudinal depth of either respective container; and a hook disposed proximate the closed bottom portion and oriented on a side of the bucket portion opposite the first foot and the second foot.

21. An ice tote comprising:

a body defined by a closed end and an upstanding side wall that terminates at an opening defined by the body;

a handle pivotably connected to the body proximate the opening;

a plurality of grip sites defined by the body wherein at least one grip site is defined by the closed end of the body;

at least one post disposed between the handle and a bottom surface defined by the closed end of the body, the at least one post extending in an outward direction from the body and constructed to facilitate non-nested stacking of vertically adjacent ice totes; and a hook extending from the body at a location between the at least one post and an another post that is a mirror construction of the at least one post.

22. The ice tote of claim 21 wherein the hook extends from the body at a location generally under a spout defined by a portion of the upstanding wall proximate the opening.

23. An ice tote comprising:

a body defined by a closed end and an upstanding side wall that terminates at an opening defined by the body;

a handle pivotably connected to the body proximate the opening;

a plurality of grip sites defined by the body wherein at least one grip site is defined by the closed end of the body;

at least one post disposed between the handle and a bottom surface defined by the closed end of the body, the at least one post extending in an outward direction from the body and constructed to facilitate non-nested stacking of vertically adjacent ice totes; and a hanger constructed to removably cooperate with at least one of a hook and the at least one post and securable to a vertical surface, the at least one of the hook and the at least one post being oriented to cooperate with the hanger such that the body can be hung in a vertical position with the opening in a downward facing direction.

* * * * *